US006535134B2

(12) United States Patent
Lang et al.

(10) Patent No.: US 6,535,134 B2
(45) **Date of Patent: *Mar. 18, 2003**

(54) METHOD FOR THE GENERATION OF AN ELECTRICAL SIGNAL SENSOR DEVICE FOR EXECUTING THE METHOD AND THE USE OF THE SENSOR DEVICE

(76) Inventors: Edo Lang, Churweg 5, CH-7203, Trimmis (CH); Roland Obrist, Chalamandrin, CH-7412, Scharans (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 156 days.

(21) Appl. No.: 09/298,992

(22) Filed: Apr. 26, 1999

(65) Prior Publication Data

US 2001/0035826 A1 Nov. 1, 2001

(30) Foreign Application Priority Data

Apr. 27, 1998 (CH) ..... 0943/98

(51) Int. Cl.[7] ..... G08B 21/00
(52) U.S. Cl. ..... 340/603; 340/604; 340/622
(58) Field of Search ..... 340/603, 604, 340/606, 618; 4/302, 305; 374/121, 141

(56) References Cited

U.S. PATENT DOCUMENTS 3,751,736 A * 8/1973 Egli ..... 4/100
4,205,403 A * 6/1980 Blankenship ..... 4/111
4,326,199 A * 4/1982 Tarpley et al. ..... 340/622
4,619,140 A * 10/1986 Kiihnel ..... 73/295
5,111,692 A * 5/1992 McQueen et al. ..... 73/295
5,421,202 A * 6/1995 Le Pimpec ..... 73/295
5,493,100 A * 2/1996 Renger ..... 219/497
5,685,194 A * 11/1997 McCulloch et al. ..... 73/295
6,061,843 A * 5/2000 Rump et al. ..... 4/302
6,098,457 A * 8/2000 Poole ..... 73/295

FOREIGN PATENT DOCUMENTS

| | | |
|---|---|---|
| DE | 0 120 509 | 2/1987 |
| DE | 0 269 823 | 4/1989 |
| DE | 40 03 638 | 8/1990 |
| DE | 43 06 457 | 9/1994 |
| DE | 0 675 234 | 10/1995 |
| EP | 0210509 A * | 2/1987 |

* cited by examiner

*Primary Examiner*—Jeffery Hofsass
*Assistant Examiner*—Son Tang
(74) *Attorney, Agent, or Firm*—Browdy and Neimark

(57) ABSTRACT

A method for generating an electrical signal and a sensor device (10) for executing the method. The signal is generated because of a change in a fluid-filled space. A sensor element (12) of the sensor device (10) detects the heat transfer over time between the sensor element (12) and the fluid. The sensor element (12), which has a temperature-dependent electrical conductivity and to which a voltage has been applied, is brought to a temperature which lies outside the range of the fluid temperatures. In the passive phase, the fluid is brought to a constant passive temperature by a heat transfer between the sensor element (12) and the surroundings. The sensor device (10) provides a constant passive output voltage. A heat transfer between the sensor element (12) and its surroundings takes place in the active phase by changes in the fluid-filled space. The sensor device (10) provides an active output voltage, which is different from the passive output voltage. When a difference between the output voltages is exceeded, the signal is generated. The device can be used for triggering the flushing action in sanitary installations, and for keeping a level constant, for example in aquarium installations.

23 Claims, 9 Drawing Sheets

| Sensor device | acc.to Fig.4 | | acc.to Fig.5 | |
|---|---|---|---|---|
| PHeat [W] | 0,7 | 1,2 | 0,7 | 1,2 |
| UHeat [W] | 13 | 16 | 13 | 16 |
| Delta UHL max [V] | 0,74 | 0,36 | 1,14 | 0,85 |
| tg (4 sec) : Fluid1/Fluid2 [mV/sec] | 90 | 50 | 255 | 200 |
| tg (4 sec) : Fluid2/Fluid1 [mV/sec] | 55 | 50 | 120 | 160 |
| Delay Fluid1/Fluid2 [sec] | 0,5 | -- | -- | -- |
| Delay Fluid2/Fluid1[sec] | 1 | 1,5 | 0,3 | -- |
| Sealing compound KW | 0,5 | 0,5 | 0,5 | 0,5 |
| Covering plastic with fiberglass | X | X | | |

METHOD FOR THE GENERATION OF AN ELECTRICAL SIGNAL SENSOR DEVICE FOR EXECUTING THE METHOD AND THE USE OF THE SENSOR DEVICE

FIELD OF THE INVENTION

The invention relates to a method for generating an electrical signal by means of a sensor device as a function of a change from an active phase to a passive phase in a space filled with a fluid, wherein a sensor element of the sensor device detects the heat transfer between the sensor element and the fluid over time. The invention further relates to a sensor device for executing the method, and to the use of such a sensor device.

BACKGROUND OF THE INVENTION

Automatically operating flushing devices are preferably used for flushing urinal bowls in public restrooms. These are understood to be flushing devices which either perform flushing at defined time intervals, regardless of whether the bowls had been used or not, or flushing devices, wherein flushing is started based on any arbitrary, for example mechanical or electrical, signal, for example, which is generated when the bowls are used.

The disadvantage of the flushing devices operating at time intervals lies in that, when the bowls are intensely used, they are flushed too seldom, which leads to a lack of sanitation and the emission of odors while, in case of little use, flushing operations take place without the bowls having been used, which means a waste of water. Furthermore, periodically occurring flushing operations also take place while the bowls are being used, which can be unpleasant for the user of toilet bowls in particular. Flushing devices, which are started by signals generated by sensors when the bowls are used, do avoid the disadvantage of too few, too many or chronologically undesired flushing operations. Systems with photoelectric barriers are most frequently employed, wherein a beam impinging on a optical sensor is reflected by the user, wherein the flushing device is activated immediately or after the user has stepped back out of the range of the beam. The disadvantage of such and other sensor-controlled flushing devices lies mainly in that the easily visible sensor devices often do not operate well or not at all, because they are purposely or inadvertently disrupted or destroyed, and that flushing is also triggered by persons present in the range of the beam, even if the bowl has not been used at all.

In addition to this, there is the danger of water damage, both with periodically operating and controllable flushing devices, because of overflowing bowls, because the flushing operations continue to be performed even if the drains are plugged.

OBJECT AND SUMMARY OF THE INVENTION

It is therefore the object of the invention to prevent the mentioned disadvantages and to propose a method with which electrical signals for activating the flushing are generated, wherein the danger of water damage because of overflowing or plugged up drains is avoided.

It is a further object of the invention to create a sensor device operating in accordance with the novel method, whose production and installation is simple and cost-effective and which operates with few malfunctions, or respectively almost maintenance-free.

A still further object of the invention is to propose the use of such a device.

The principle of the invention resides in generating an electrical signal as a function of a voltage change. The changing voltage can be picked up at a sensor element to which a voltage has been applied. Essentially, the sensor elements consist of a material with a temperature-dependent electrical conductivity, which is located in a space filled with a fluid. In a passive phase, i.e. when no electrical signal is to be generated and therefore the voltage is to remain constant, this sensor element is continuously heated or cooled, so that it is brought to a passive temperature, which in any case lies outside the temperature range of the fluid in the following active phase, and generally also outside of the temperature range of the fluid in the passive phase. This has the result that in the passive phase a heat transfer either from the sensor element to the fluid or from the fluid to the sensor element takes place, which becomes stationary after a certain time. If now a change occurs in the vicinity of the sensor element in the space filled with fluid, which increases the heat transfer, the temperature of the element changes because of the greater or smaller amounts of heat being absorbed or given off per unit of time, since it is heated or cooled not to a constant temperature, but with a constant output. Within the framework of the present invention, such a change in the fluid-filled space is to be understood not only to be a change in the temperature of the fluid, but also a change of the chemical consistency, and therefore of the heat-absorption capability of the fluid. In other words, a replacement of the fluid present in the state of rest by another fluid, and/or a change of the aggregate state of the fluid, and/or a change in the flow rate of the fluid, and/or a change in the level of a liquid fluid. It is known that the amount of heat absorbed over time by the fluid is not only a function of the temperature difference between the element and the fluid, but also of the capacity of the fluid for absorbing heat, essentially therefore of the flow rate of the fluid, wherein a rapid flow increases the heat transfer because of convection occurring in the course of this. The active phase starts with the change, i.e. that, as already mentioned, the heat transfer between the sensor element and the fluid is changed because of the change in the fluid-filled space, which results in a change in the temperature of the sensor element and therefore a change in the output voltage. The latter is used directly or indirectly as a signal, for the generation of which the novel method, or respectively the novel sensor device, is used.

A preferred use of the novel sensor device is the automated flushing of urinal or toilet bowls. Here, water damage because of overflowing is prevented, even when the outlet is plugged up. If the outlet of the urinal or toilet bowl is plugged up, it is automatically provided that no change in the amount of heat given off by the element, and therefore no heating or cooling of the element, no change of the output voltage and no further flushing operation takes place at all. Moreover, flushing is only triggered if the urinal or toilet bowl is actually used.

Installing the novel sensor device, for example in existing urinal bowls, is simple. The sensor device, or possibly elements thereof, can be easily replaced in case of outages.

The sensor device, or respectively the sensor element, can be cast into a wall simultaneously with the construction of the latter. However, in this case it can generally not be exchanged, so that this concept can only be used for sensor elements with a very long service life and very slight tendencies to become defective. The problems regarding the service life, or respectively the tendency to become defective, become moot if, in place of the sensor device itself, only a holding arrangement for the latter is integrally provided in the wall, in which an exchangeable sensor device can be fastened.

The sensor device, or respectively the sensor element can be installed in various locations. Fastening locations can be provided ahead of or behind the odor barrier on a lower, or a lateral or, suspended from an upper, fastening surface, wherein the latter has the advantage that the danger of a covering of dirt over the sensing area is less. In any case, it is advantageous if the sensing area of the sensor device is not arranged in a depression of the wall, but flush with the wall or projecting slightly into the interior, so that it is actually washed by the flushing water. In this way the formation of a sump of urine deposits and/or other soiling is prevented in an efficient manner.

It is particularly advantageous to mount the sensor device, or respectively the sensor element, at a location which is not accessible to the users. In this way the purposeful or possibly also inadvertent damage is prevented. In public restrooms in particular it is prevented vented in this way that the sensor device, or respectively the sensor element, and therefore the flushing device, become the victims of acts of vandalism.

Up to now, the use of the novel device has been mainly addressed in connection with urinal bowls. Such a sensor device can of course also be employed in other ways, in the sanitary field not only with toilet bowls, but also in sinks of the most diverse different kinds. Outside of the sanitary field, the sensor device can also be used in the most diverse ways, for example as a leak detector for liquid media, for example oil catch basins, as a low filling level detector, in particular in the field of aquarium keeping, as a protection of pumps against dry running, as an alternative to floats for measuring the level of liquids, as well as a replacement for mercury switches. It should be pointed out that the sensor device is also suitable in cases in which flammable or explosive fluids are involved.

In connection with toilet bowls it is necessary to prevent a seated or crouching user from being splashed in an undesirable manner when flushing is actuated. To this end flushing can be delayed, for example. Another option lies in actuating flushing immediately, wherein the toilet bowl must be shaped in such a way that the user is not splashed, by means of which odor emissions are minimized. Finally, the invention can also be used in combination with an automatic device, such as the one known by the name "Klosomat", for example.

The device advantageously has a regulator, by means of which the chronological flushing behavior can be affected, possibly in an adjustable manner. For example, in connection with urinal bowls it is advantageous to provide wetting of the wall, on which the stream of urine impinges, by means of pre-flushing immediately when they are used, in this way the reflection and spraying of the stream can be prevented and the problem-free run-off along the wall wetted by the pre-flushing can be assured. To prevent too long a time without flushing, it is also advantageous to trigger flushing at defined periods of time, even if the bowl had never been used since the previous flushing. Such flushing can also take place with an increased amount of water, if necessary, and can be used as periodic cleaning flush, so to speak, or can assure the suppression of odors. It is also possible to add a cleaner, or respectively disinfectant or a deodorizing agent to the flushing water for a cleaning flush for increasing the sanitary standards, or respectively for preventing offensive odors.

Preferably the signal has a strength which does not require further, or at least no significant amplification.

The reaction of the sensor element to changed conditions of its environment, which result in a change in the terminal voltage, takes place all the faster, the faster the required temperature change of the NTC, or respectively PCT resistor takes place. To achieve this it is advantageous if the mass is low and the temperature difference between the temperature at rest and the initiating temperature is great. A small mass is also advantageous because it reduces the energy used for heating, or respectively cooling it. But a large temperature difference has the result in principle that the energy requirement for heating or cooling is comparatively great. However, this is not very important because of the heating or cooling energy required which, absolutely considered, is small.

The sensor device itself is simple to manufacture and cost-effective. It can be produced in such a way that it is not attacked by either urine or chemicals, such as strong cleaning agents, for example. As already mentioned, it is also suitable for contact with explosive and flammable materials, since no spark, which touches the fluid(s), is generated by the electrical signal.

Heating or cooling of the sensor element, whose electrical resistance is a function of the temperature, can be provided directly or indirectly. With indirect heating, or respectively cooling, a heating, or respectively cooling element is heated, or respectively cooled, which in turn heats the element by heat conduction, convection and/or radiation. The heat transfer between the heating resistor and the sensor element is preferably aided by a material with good heat conduction, which connects the two. This material can also fill the entire free space inside the housing. With direct heating, or respectively cooling, the sensor element itself is electrically heated, or respectively cooled, which has the advantage that only two cables are needed for wiring in place of three or four cables with indirect heating, or respectively cooling, but with the disadvantage of the non-independent voltage.

In general, the sensor element and, if desired, the separate heating, or respectively cooling element, as well as the wiring, are arranged in a sensor housing made of a material which is insensitive to the fluids with which it comes into contact, and which is hermetically sealed. Suitable materials are glass, plastics, such as teflon, for example, and metals which are resistant to the respective fluids.

It is further possible to design the sensor element and the housing integrally, wherein the element is embodied housing-like, so to speak, and only needs to receive the wiring and, if required, i.e. with indirect heating, or respectively cooling, also the heating, or respectively cooling element.

Further details and advantages of the invention will be explained in what follows by means of exemplary embodiments of the invention, making reference to the drawings.

DESCRIPTION OF THE PREFERRED EMBODIMENTS

Figure 1:
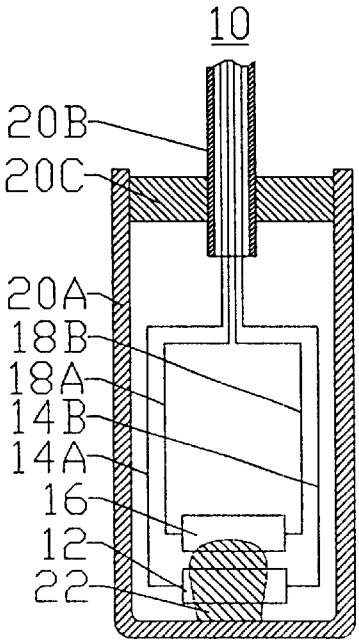
FIG. 1 shows a first exemplary embodiment of a sensor device with indirect heating of the sensor element and with four lines.

FIG. 1 shows a sensor device 10 with a sensor element 12 with lines 14A, 14B, to which voltage has been applied, as well as a heating element in the form of a heating resistor 16, which is connected via lines 18A, 18B to a current or voltage source, not represented, and is used for heating the sensor element 12. The sensor element 12 consists of a resistor with a temperature-dependent conductivity, in the present case an NTC (negative temperature coefficient) resistor. The sensor element 12, the heating element 16 and a housing 20, which will be described further down below, are connected by a thermally conducting material, or respectively conductor paste 22, i.e. the sensor element 12 is being indirectly heated. The sensor device 10 further includes the already mentioned housing 20 consisting of a cell 20A and a cover 20C, which enclose the sensor element 12, the heating element 16, the conductor paste 22 and the lines 14A, 14B, 18A, 18B, wherein the lines 14A, 14B, 18A, 18B are conducted through a sleeve 20B of the cover 20C.

Figure 2:
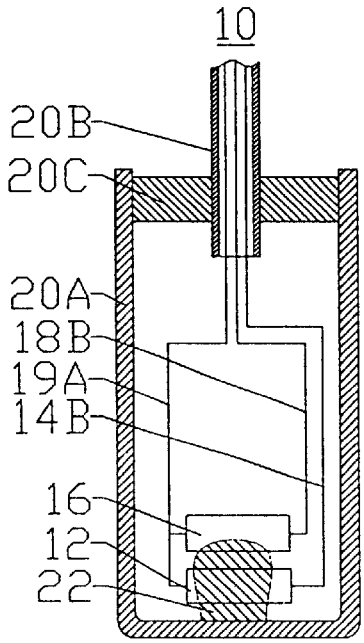
FIG. 2 shows a second exemplary embodiment of a sensor device with indirect heating of the sensor element and with three lines.

FIG. 2 shows a further sensor device 10, which only differs from the sensor device in accordance with FIG. 1 in that in place of the lines 14A and 18A only a single line 19A is provided. The advantage of this sensor device lies in that it is structurally slightly simpler than the sensor device in accordance with FIG. 1, since only the three line connections 19A, 14B, 18B are provided, but on the other hand its function is less precise because of the mutual influence by the common line 19A.

Figure 3:
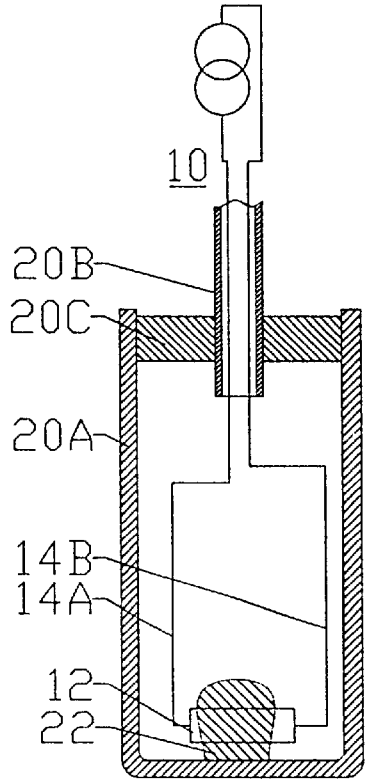
FIG. 3 shows a third exemplary embodiment of a sensor device with direct heating of the sensor element.

A sensor device 10 is represented in FIG. 3 which, like the sensor device in FIG. 1, includes the sensor element 12 with the two lines 14A, 14B, the conductor paste 22, the cell 20A, the sleeve 20B and the cover 20C. The sensor element 12 of this sensor device 10 is directly heated by means of a voltage source, therefore no heating element and lines connecting it with a current source are provided.

Figure 4:
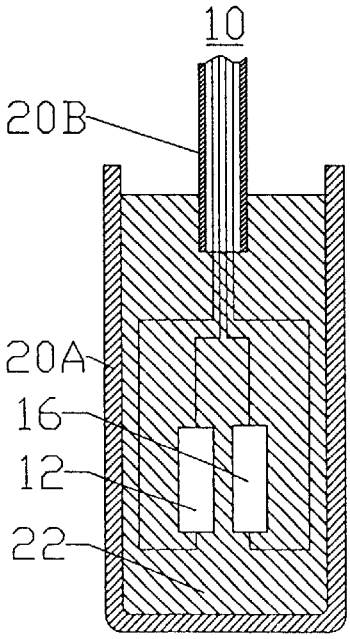
FIG. 4 shows a fourth exemplary embodiment of the sensor device with a cell filled with a sealing compound.

FIG. 4 shows a sensor device 10 with a sensor element 12, a heating resistor 16, the lines 14A, 14B, 18A, 18B and the cell 20A. Here, the conductor paste 22 is not only present in the area of the heating resistor 16, the sensor element 12 and the bottom of the cell 20A, instead it fills the entire free space of the cell 20A in the form of a sealing compound and also replaces the cover 20C, while the sleeve 20B is also enclosed in the sealing compound.

Figure 5:
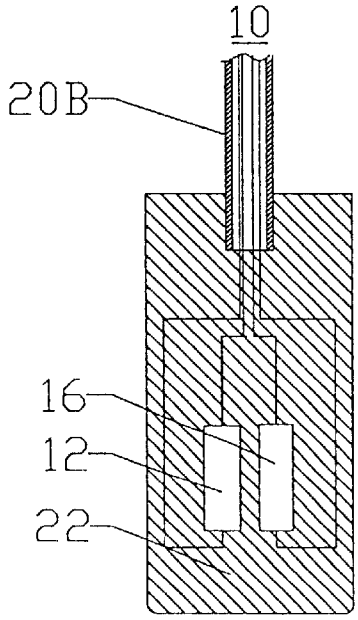
FIG. 5 shows a fifth exemplary embodiment of the sensor device without a cell.

A simplified embodiment of the sensor device 10 is represented in FIG. 5, which differs from the exemplary embodiment in FIG. 4 by not having a cell 20A. Here, the conductor paste, or respectively sealing compound 22 not only has replaced the cover 20C as in the embodiment of FIG. 4, but also the cell 20A, wherein the sleeve 20B is again enclosed in the sealing compound.

Figure 6:
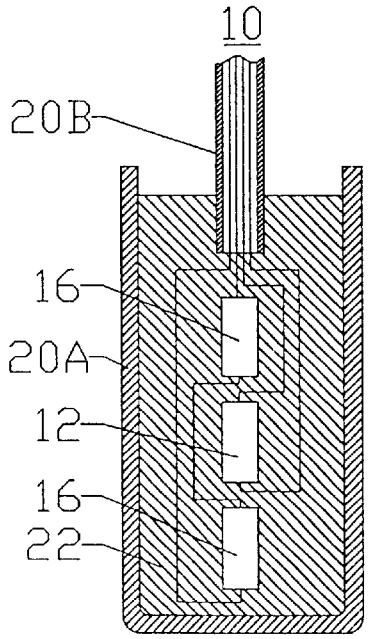
FIG. 6 shows a sixth exemplary embodiment of the sensor device with two heating elements.

FIG. 6 shows a further variation of the sensor device 10, wherein the cell 20A is completely filled with the sealing compound 22. One sensor element 12 and two heating elements 16A, 16B, which are arranged in a cascade circuit, are provided in this sensor device 10. It is also possible to provide the sensor device with several heating elements, or respectively several sensor elements.

With all sensor elements of FIGS. 1 to 6, the heat transfer from the heating element to the sensor element takes place by heat conduction through the conductor paste, or respectively the heat-conducting material 22. However, this heat transfer could also take place differently, for example by radiation.

It is obvious that the elements which come into contact with the fluids, for example in the sanitary field with air, water, urine, cleaning materials, and in other applications with crude petroleum products and chemicals of the most varied types, in particular the cell 20A, and possibly the sleeve 20B, the cover 20C, as well as the heat-conducting material 22, must be made of materials which are not corroded by the fluids. Inter alia, glass, plastics or resistant metals are suitable for the cell.

Figure 8:
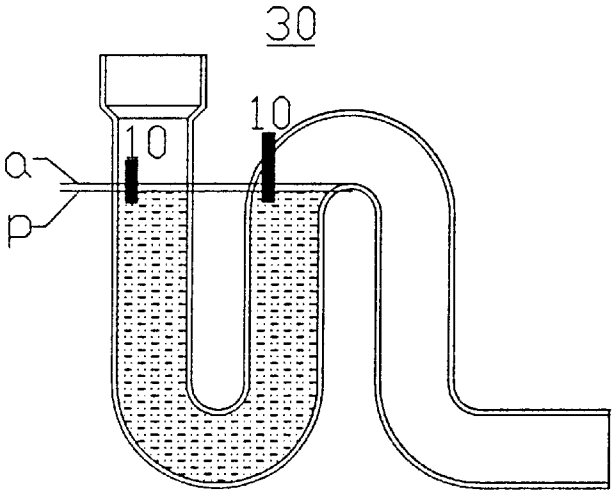
FIG. 8 shows the siphon of FIG. 7 with sensor elements in further installed positions.
Figure 7:
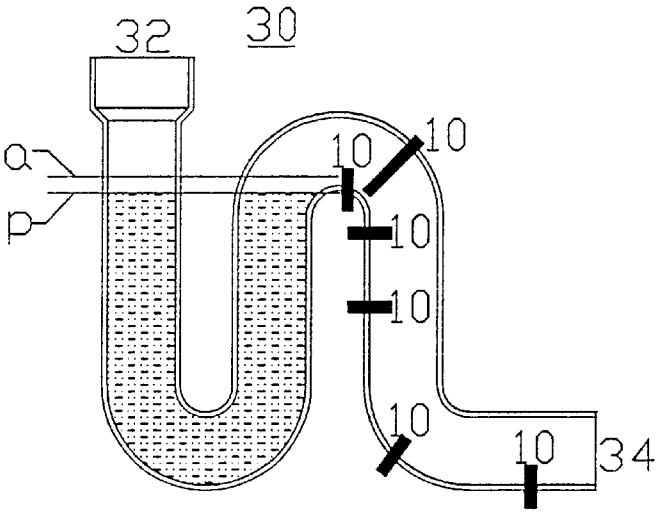
FIG. 7 shows a siphon with sensor devices in various installed positions.

FIGS. 7, 8, as well as 9A, 9B and 10A, 10B, show different possibilities for installing a sensor element 10, for example one of the sensor elements represented in FIGS. 1 to 6, in the drainage area of a sanitary installation, for example a urinal bowl.

The cross section of a conventional odor barrier, or respectively a siphon 30, is represented in FIG. 7 and FIG. 8, wherein in the installed state the upper end 32 is connected with a urinal bowl, not represented, and the lower end 34 with a waste water line, not represented. The water level during the passive phases, i.e. when the urinal bowl is not being used, is identified by p, in the active phase by a. Various sensor devices are represented in the siphons 30, but this only to show possible installation positions, since in actuality only a single sensor device will be present.

FIG. 7 shows sensor devices 10 in installed positions, wherein the fluid surrounding the sensor device in the passive phases consists of the ambient air, while in the active phases it essentially consists of water with slight additions of urine. Here, the change in the fluid consists in that, first, the gaseous fluid, namely the ambient air, is replaced by a liquid fluid, namely essentially water, because of which the heat transfer is greatly increased since the thermal transition resistance drops considerably, and that secondly the temperature of the water is lower than the ambient air, which had been heated by the sensor element during the passive phase, and that thirdly water flows, while the ambient air is practically unmoving. These three facts have the effect that during the active phase a larger amount of heat is emitted over time by the sensor device, or respectively the sensor element, so that the temperature of the sensor elements drops and its electrical conductivity is changed by this, wherein the change in electrical conductivity is converted into an electrical signal, which causes flushing. Flushing preferably only takes place after the use of the urinal bowl is terminated.

FIG. 8 shows two possibilities for the installation of the sensor element 10, whose surroundings are constituted by a liquid fluid, namely water with an admixture of urine, or respectively only water, not only in the active phase, but partially already in the passive phase. The change occurring at the start of the active phase here partially includes the change in the temperature of the fluid and the change in the velocity of the fluid, but only partially the replacement of the gaseous fluid by liquid fluid. Here, too, the thermal transition resistance drops at the start of the active phase.

Figure 9B:
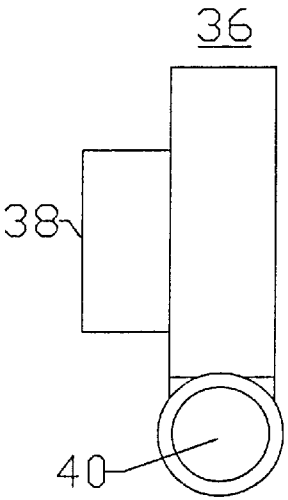
FIGS. 9A, 9B show a further siphon in various installed positions in a vertical sectional view, or respectively in a lateral view.
Figure 9A:
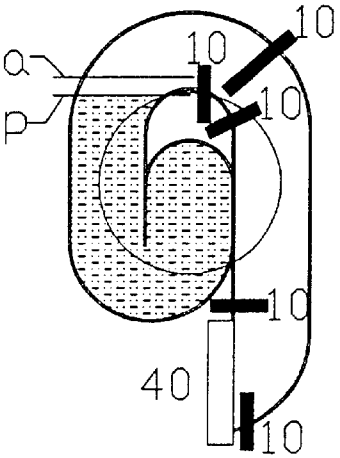

A suction siphon 36 is represented in FIGS. 9A, 9B, as well as 10A, 10B, having an upper end 38 which, in the installed state, is connected with the drain of a sanitary installation, not represented, such as a urinal bowl, and having a lower end 40 which, in the installed state, is connected with a waste water line, not represented. The possible water levels are identified as in FIGS. 7 and 8 by p, or respectively p and a.

Figure 10B:
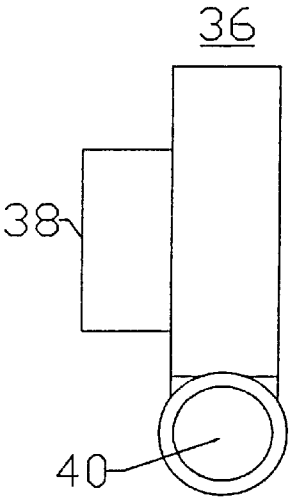
FIGS. 10A, 10B show the siphon of FIGS. 9A, 9B with sensor devices in further installed positions in a vertical sectional view, or respectively in a lateral view.
Figure 10A:
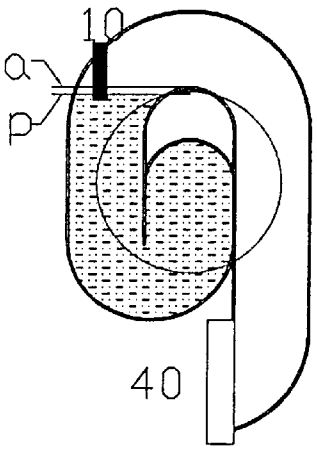

FIG. 9A shows sensor elements 10 which, analogously to FIG. 7, are installed in such a way that in the passive phase they are surrounded by still air, in the active phase by flowing water. FIG. 10A shows sensor elements 10 which, analogously to FIG. 8, are installed in such a way that in the passive phases they are surrounded by still water, in the active phases by flowing water.

Figure 11:
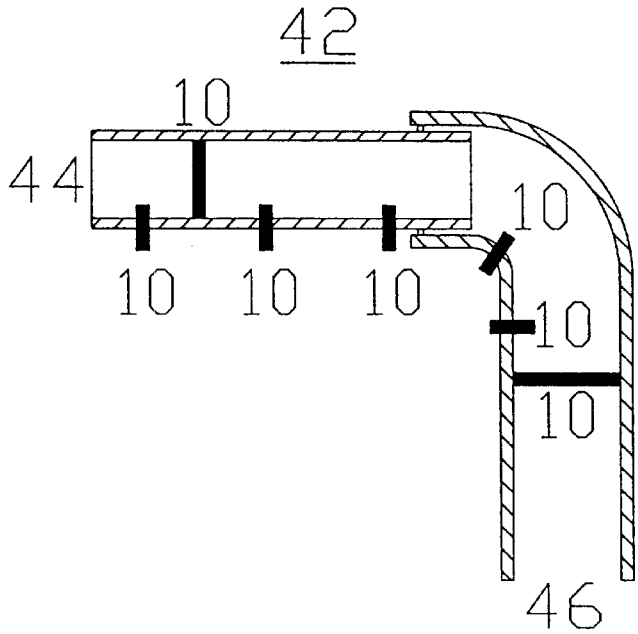
FIG. 11 shows a drain pipe of a sanitary installation with sensor devices in various installed positions.

In accordance with FIG. 11, the sensor devices can also be arranged downstream of the siphon, i.e. in the area of a siphon drain pipe 42, whose upper end 44 is connected to the siphon, not represented here, and whose lower end 46 constitutes the drain. Not only are different installed position of the sensor device 10 represented in FIG. 11, but it is also shown that the sensor devices 10 can be also designed to be annular instead of stopper-like.

Figure 12:
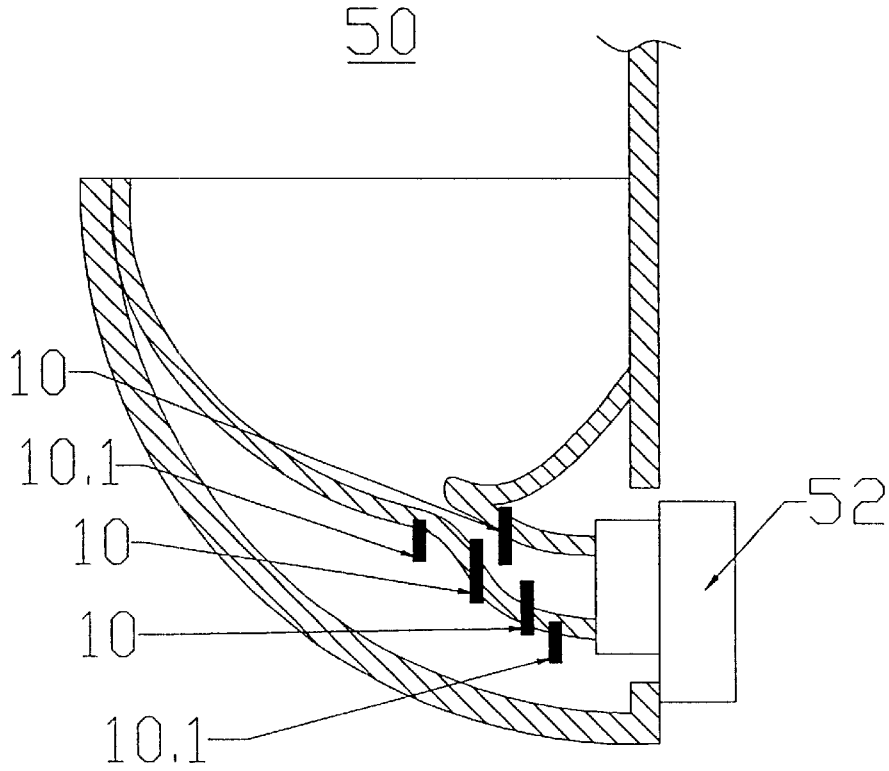
FIG. 12 shows a urinal bowl with sensor devices in various installed positions.

A urinal bowl 50 is represented in FIG. 12, whose lower end terminates in a siphon 52, represented in a simplified manner. Here, too, several sensor devices 10 are represented in various possible installed positions. Sensor devices which have been installed in a suspended position have the advantage, that no protective cap is formed on them, for example made of scale from urine, hair, small bits of paper, etc., which would prevent correct functioning. While the sensor devices 10 project into the interior of the urinal bowl 50, the sensor devices 10.1 are completely enclosed in the wall of the urinal bowl which, for example, is made of a ceramic material. Both in the passive phase and the active phase, the surroundings of the sensor device here consist of a solid and stationary material. Thus the change occurring in the surroundings of the sensor material during the transition from a passive phase to an active phase consists exclusively of a drop in temperature. Of course a change of the heat conduction because of the change in the material surrounding the sensor device, or a change in the flow speed in the surroundings of the sensor devices 10.1 occurs only to a decreased extent.

While FIGS. 7 to 12 were always related to the use of the sensor device in a sanitary installation, for example a urinal or toilet bowl, FIGS. 13 to 16 show the use of the novel sensor elements for different purposes.

Figure 13A:
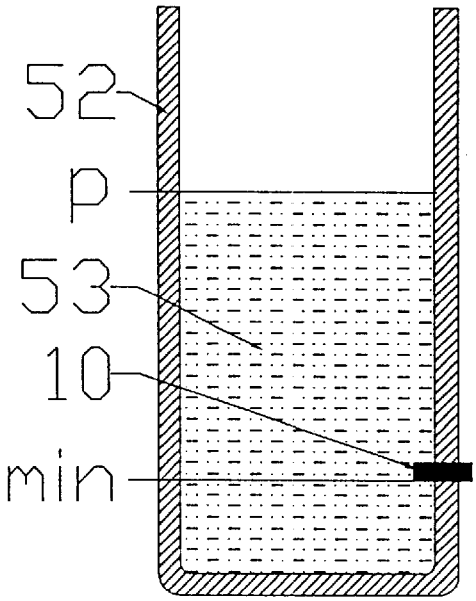
FIG. 13A shows a container for liquids with a sensor device for monitoring a first extreme level.

In FIG. 13A, a sensor device 10 for monitoring a minimum level min is arranged in a container 52 which contains a liquid 53. In this case, the time in which the actual level p lies above the minimum level min can be considered to be the passive phase. Thus the sensor device as represented in FIG. 13 is contained in the liquid 53. The active phase is understood to occur when the actual level p falls below the minimum level min, so that the sensor device 10 is no longer in a liquid, but in a gaseous fluid. In this case the heat transfer is reduced during the transition into the active phase. The signal resulting from this in the end causes the supply of fresh liquid 53 to the container 52 until the actual level p again lies above the minimum level min. The sensor device can be arranged in this case either in the interior of the container 52, as represented, or in the interior of the wall of the container 52, or possibly on the exterior of the wall of the container 52.

Figure 13B:
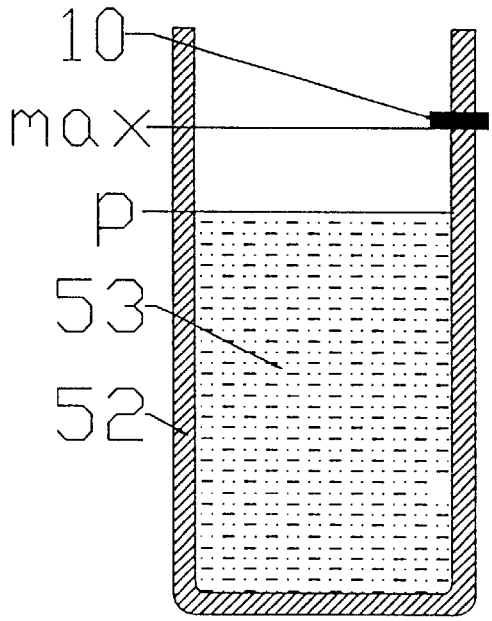
FIG. 13B shows a container for liquids with a sensor device for monitoring another extreme level.

In a corresponding manner it is also possible in accordance with FIG. 13B to use the sensor device 10 as a protection against overfilling. In this case the sensor device 10 is in the passive phase when the actual level p lies below the maximum level. The installation position is selected to be such that in the passive phase the sensor device is in air, while with the onset of the active phase it is immersed in the liquid because of the rise of the level to max.

The sensor device can also be attached in a height-adjustable manner in the container for monitoring a minimum level as well as for monitoring a maximum level.

Figure 14:
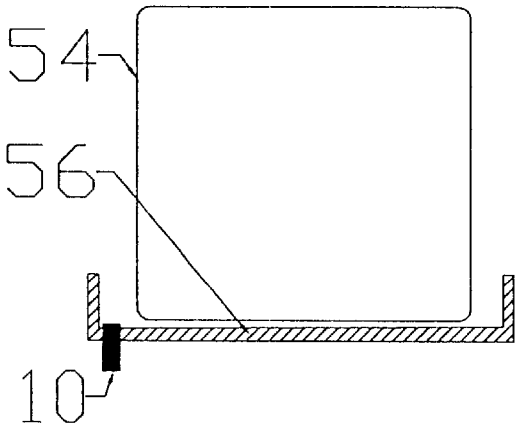
FIG. 14 shows a tank in a collecting tub with a sensor device for detecting a leak.

FIG. 14 shows the use of the novel sensor device 10 for monitoring a container for leaks, such as for example a trough 56 surrounding a fuel oil tank 56. In the passive phase the sensor device 10 is in air, in the active phase in fuel oil.

Figure 15:
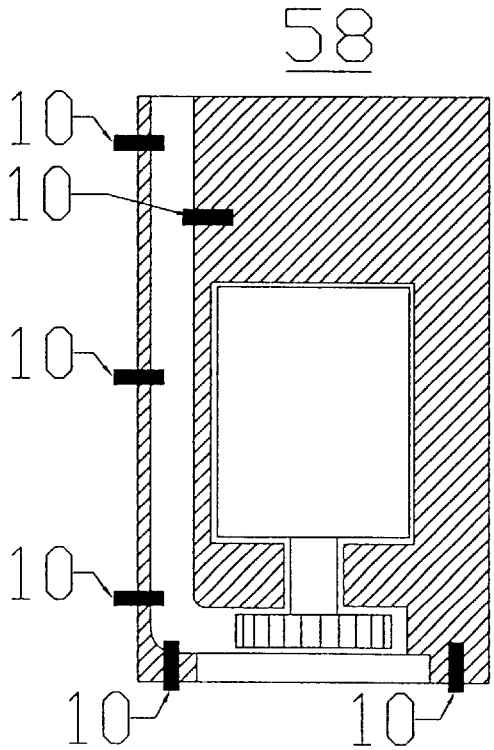
FIG. 15 shows a pump with sensor elements in various installed positions for detecting and preventing dry running.

The use of a sensor device 10 for preventing dry-running of a pump 58 is represented in FIG. 15. The sensor device can be installed in various positions. In the passive phase it is in a liquid and at the start of the active phase it comes into contact with air. It is possible by means of the signal resulting from the change to either switch off the pump 58, or to provide more liquid to the pump 58.

Figure 16:
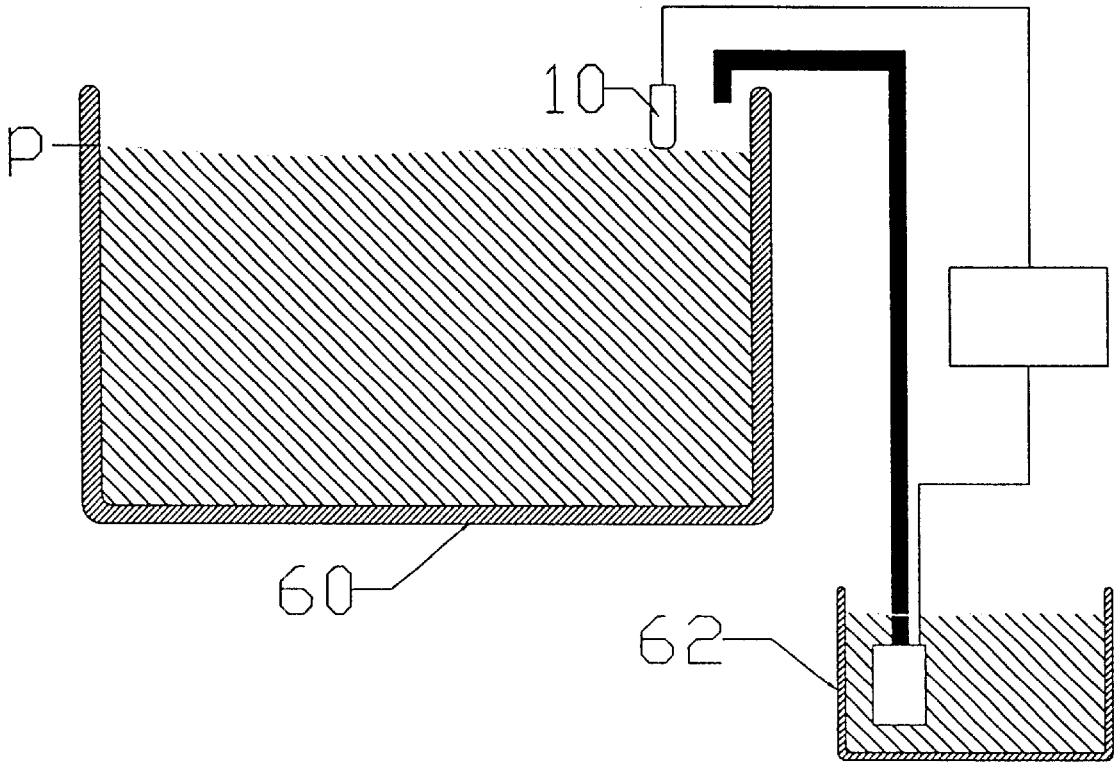
FIG. 16 shows an aquarium tank with a reserve tank with a sensor device as a level monitor.

FIG. 16 represents the use of the novel sensor device 10 in connection with aquariums. Here, the level p is sensed by the sensor device 10 immersed in the passive phase into the water of an aquarium tank 60. When the level falls below a minimum level min, the sensor device 10 is no longer in water, but in air. In this active phase additional water, generally processed for the required application, is supplied to the aquarium tanks 60 from a reservoir 62. By means of this arrangement it is achieved that the water level can be kept constant in a very precise manner, which in the present case is of great importance, since by means of this hard, encrusted lime edges are avoided.

Figure 17:
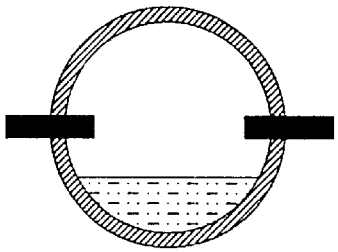
FIGS. 17, 18, 19 show three examples of the use of respectively several sensor devices as replacements for mercury switches.
Figure 18:
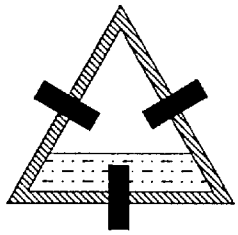
Figure 19:
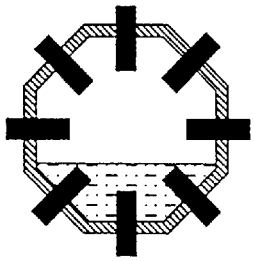

FIGS. 17, 18, 19 show how it is possible by means of the novel sensor device to create angle switches as replacements for mercury switches. In contrast with all other representations, wherein only one sensor device per arrangement is provided, even though for the purpose of explanation of possible installation positions sometime several sensor devices are represented, actually several of the novel sensor devices are used in each one of the represented angle switches.

For the meaningful and successful employment of the novel sensor device it is of great importance in many areas of use that its reaction times be short. For example, short reaction times on an order of magnitude of at most a few seconds and a sufficient amplitude of the generated signal are the goal in the sanitary field. Moreover, to prevent an integration behavior during dynamic operations, the reaction behavior during the transition from the passive to the active phase should be symmetrical to the transition from the active to the passive phase. Finally, in accordance with an ecological operation it is also desirable that the energy consumption be low. For achieving the properties just described, the circuit arrangement represented in FIG. 20, for example, has proven itself.

Figure 20:
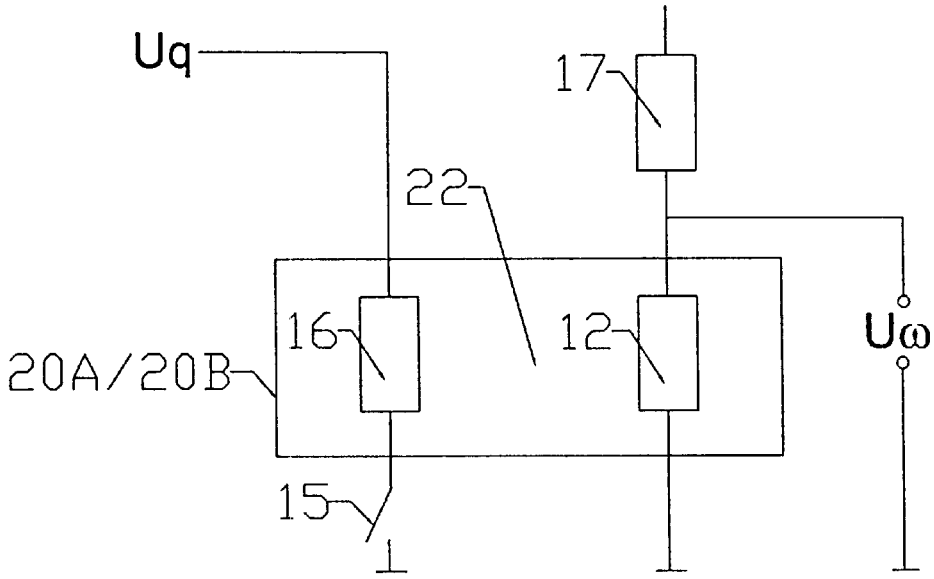
FIG. 20 is a block diagram of a suitable circuit in connection with the sensor device.

FIG. 20 relates to a sensor device 10 with indirect heating of the sensor element. The sensor element 12, the heating element 16, the cell 20A, possibly including the cover, and the heat-conducting sealing compound 22 are represented. The cell 20A can also be made of an electrically conducting material and can be heated, so that the arrangement of the heating element 16 can be omitted. Moreover, an electrical switch 15 and a protective resistor 17 have been arranged, whose position can be seen in FIG. 20. The heating voltage is identified by Uq. The output signal, i.e. the signal, for whose emission the novel sensor device 10 is used, is identified by Uomega ($U_\omega$).

Indirect heating of the sensor element 12 offers several advantages over direct heating of the sensor element by means of a constant current source. These advantages will be described below. Indirect heating permits a switching operation of the heating element 16 for heating the sensor element 12. A briefly higher, actually briefly too high load on the heating element 16, for example of 1.2 W in place of 0.4 W, is possible and results in shorter reaction times and advantageous behavior of the amplitude of the output signal Uomega. With short reaction times the energy consumption becomes minimal, and the additional circuit outlay is also minimal. A possible integration behavior of the output signal Uomega during dynamic operation is compensated. It is achieved by means of an indirect heating of the sensor element 12 by the heating element 16, that the output signal Uomega is not affected by varying self-heating, such as is the case with direct heating of the sensor element 12. The only disadvantage of indirect heating lies in that at least three lines 14B, 18B, 19A, or advantageously even the four lines 14A, 14B, 18A, 19B, are required for connecting the sensor element 12 and the heating element 16.

Figure 21A:
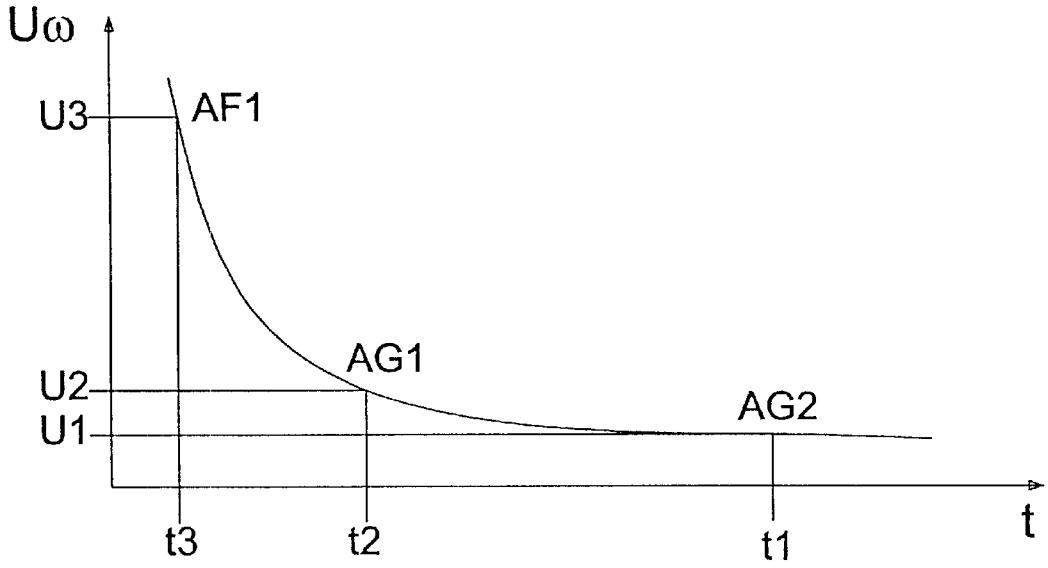
FIG. 21A is a diagram for schematically representing the progression of the output signal over time.

The progression over time of the output voltage Uomega can be seen in the diagram in FIG. 21A. The operating points in liquid fluids are designated by AF, the operating points in gaseous fluids by AG. The electronic switch 15, represented in FIG. 20, is opened when a predetermined voltage threshold of the output signal Uomega is upwardly or downwardly exceeded. It is possible to fix the operating point at AG1 in a curve range of great steepness with the aid of the electronic switch 15, from which short reaction times result. Thus, without an electronic switch the operating point at AG2 lies in a considerably flatter curve range, so that the reaction time is longer. It is moreover possible by means of the electronic switch 15 to fix the operating point AF2 at different temperatures of the gaseous fluids surrounding the sensor device 10.

Figures 21B, 22:
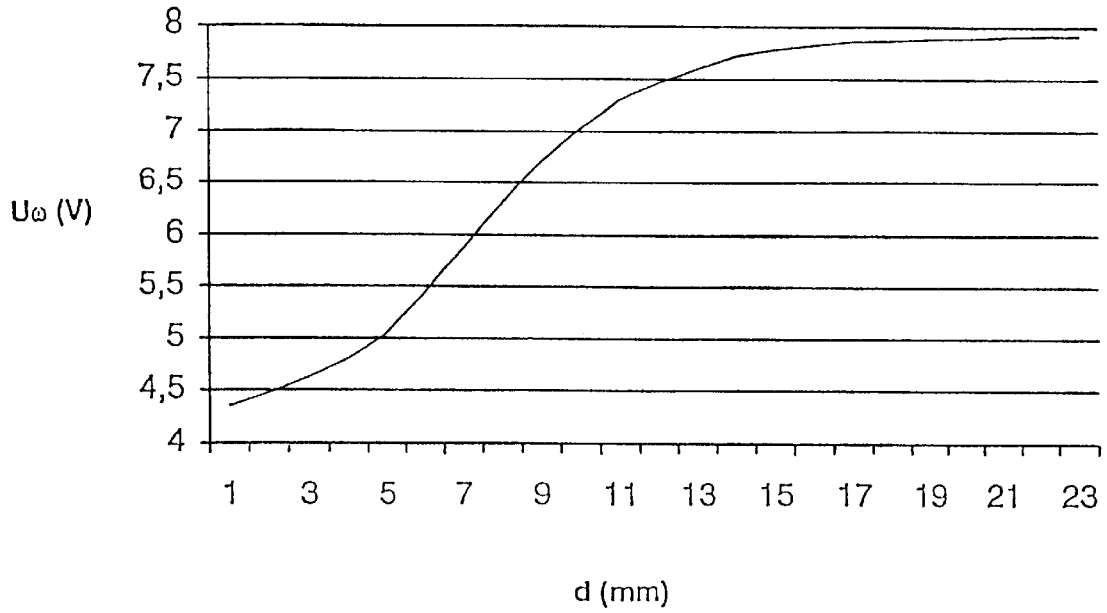
FIG. 21B is a further diagram for representing the progression of the output voltage over time when the sensor is immersed in water millimeter by millimeter.
FIG. 22 shows a table with results of measurements indicating the behavior of two different sensor devices.

The diagram in FIG. 21B shows the progression of the output voltage Uomega as a function of the immersion depth d of the sensor device 10 in water, namely with the immersion depth d being increased in millimeters.

The table represented in FIG. 22 contains details regarding the behavior of the sensor devices represented in FIGS. 4 and 5, wherein the two front columns of the table relate to FIG. 4, the two rear columns of the table to FIG. 5.

Figure 23A:
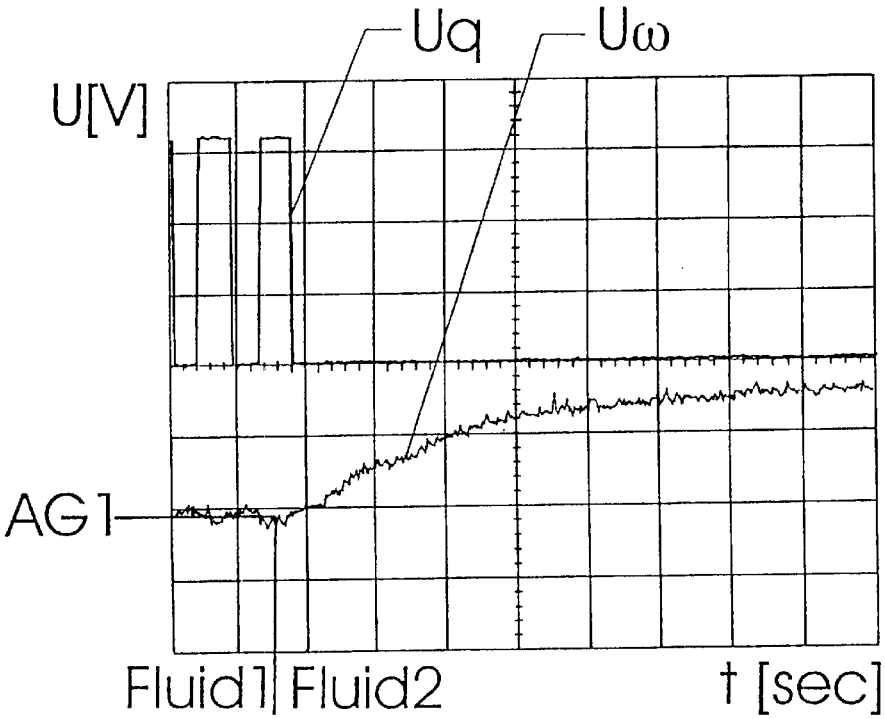
FIGS. 23A, 23B represent diagrams with results of measurements to show the behavior of the sensor devices in accordance with FIG. 4, or respectively FIG. 5.
Figure 23A:
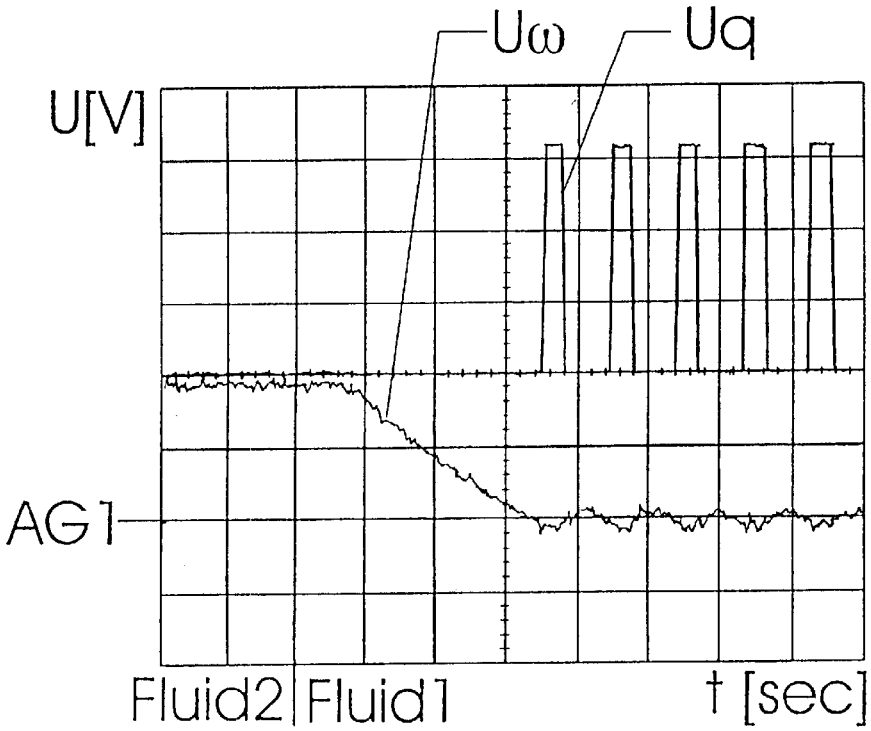
Figure 23B:
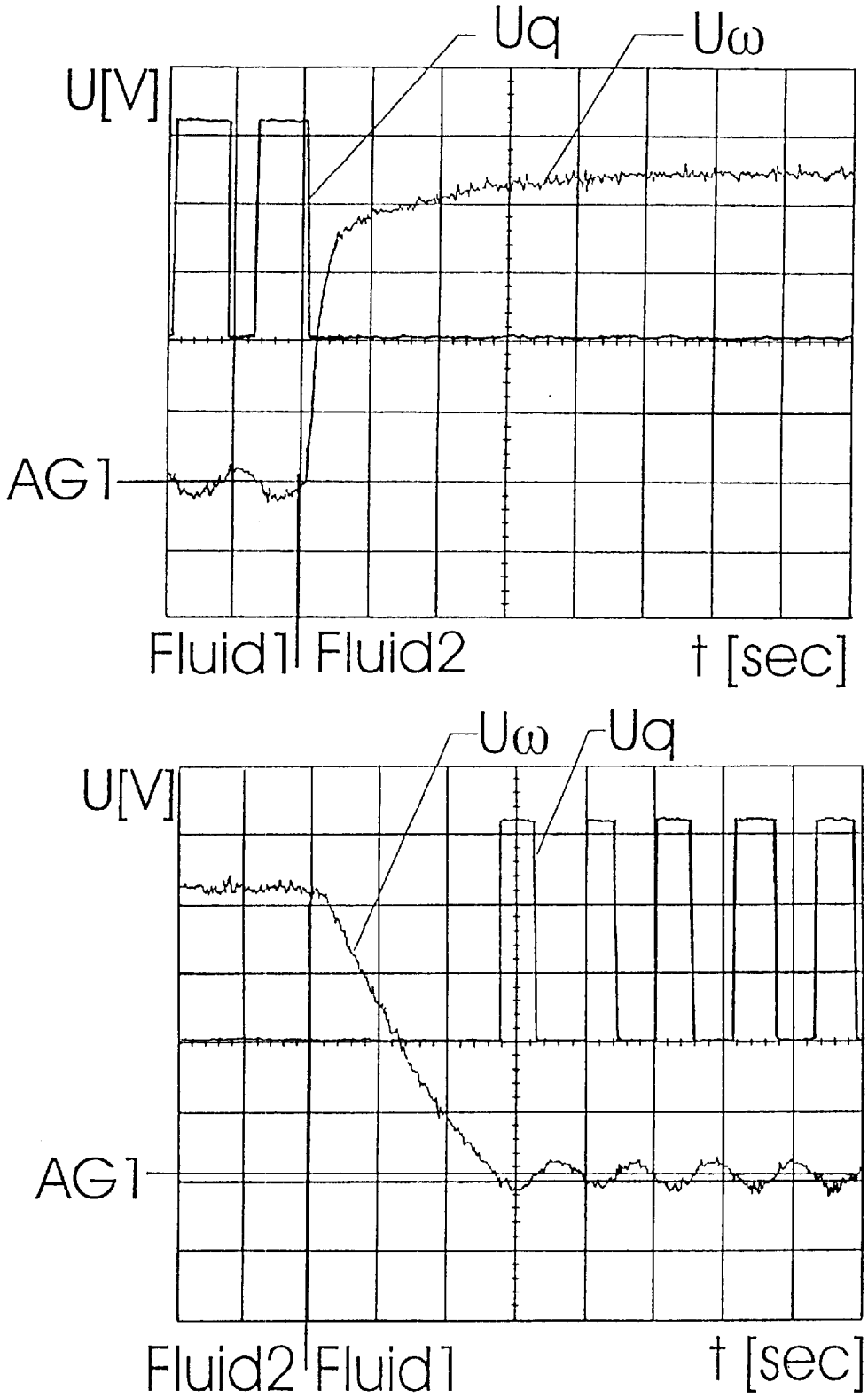

Measurement results, which document the function of the novel sensor device, are represented in the diagrams of FIGS. 23A and 23B, wherein FIG. 23A relates to the sensor device in accordance with FIG. 4, and FIG. 23B to the sensor device in FIG. 5.

What is claimed is:

1. A method for detecting a phase change between an active phase and a passive phase in a space filled with fluid, wherein the fluid has a temperature range; the method comprising:

providing a sensor element having a temperature-dependent electrical conductivity;

disposing the sensor element within the space filled with the fluid;

bringing the sensor element to a sensor temperature outside of the temperature range of the fluid, whereby a flow of heat between the sensor element and the fluid is approximately constant and wherein, in the passive phase, the electrical conductivity of the sensor element is approximately constant; and detecting the phase change between the passive phase and the active phase via an electrical change in the electrical conductivity of the sensor element.

2. The method according to claim 1, wherein the sensor element includes a sensor output voltage $U_\omega$, and wherein the step of detecting the electrical change between the passive phase and the active phase includes detecting a voltage change in the sensor output voltage $U_\omega$ which is greater than a predetermined voltage difference.

3. The method according to claim 2, wherein the step of detecting the phase change between the passive phase and the active phase includes generating a signal when the predetermined voltage difference is exceeded.

4. The method according to claim 1, including a step of bringing the fluid in the vicinity of the sensor to a substantially constant passive temperature, and wherein a sensor output voltage $U_\omega$ of the sensor element is at least approximately constant in the passive phase.

5. The method according to claim 1, comprising a step of providing a sensor device, the sensor device including the sensor element and means for detecting a heat transfer over time between the sensor element and the fluid.

6. The method according to claim 1, wherein the step of detecting the phase change between the passive phase and the active phase includes detecting in the fluid a fluid change in at least one of a fluid chemical composition, a fluid temperature, and a change between liquid and gas or vapor.

7. The method according to claim 1, wherein the sensor element includes a heat conductivity which monotonically increases with increasing temperature or monotonically decreases with increasing temperature.

8. The method according to claim 1, wherein the step of bringing the sensor element to a sensor temperature outside of the temperature range of the fluid includes applying a heating voltage to the sensor element.

9. The method according to claim 1, wherein the step of bringing the sensor element to a sensor temperature outside of the temperature range of the fluid includes applying a heating voltage to a heating resistor.

10. A sensor device (10) for detecting a phase change between an active phase and a passive phase in a space filled with fluid, wherein the fluid has a temperature range; the sensor device being disposable within the space filled with the fluid; the sensor device comprising:

a sensor element (12), having a temperature-dependent electrical conductivity;

a sensor-element heat transfer device (16, 22) to bring the sensor element to a sensor temperature outside of the temperature range of the fluid; and a voltage change detector to detect a voltage change in a sensor output voltage $U_\omega$.

11. The sensor device according to claim 10, comprising a voltage source for applying voltage to the sensor element.

12. The sensor device according to claim 10, wherein the voltage change detector detects a voltage change in the sensor output voltage $U_\omega$ which is greater than a predetermined voltage difference.

13. The sensor device according to claim 12, comprising a switch (15) automatically operable by a detection of the voltage change in the sensor output voltage $U_\omega$ which is greater than a predetermined voltage difference.

14. The sensor device according to claim 10, wherein the heat transfer device comprises an electrical heating circuit through the sensor element (12) which is distinct from a conductivity-measuring circuit through the sensor element.

15. The sensor device according to claim 10, wherein the heat transfer device comprises a heating device or a cooling device.

16. The sensor device according to claim 10, wherein the heat transfer device comprises a heating element (16) thermally coupled to the sensor element.

17. The sensor device according to claim 16, wherein a thermal coupling of the heating element to the sensor element is a direct coupling.

18. The sensor device according to claim 10, comprising a thermal-conduction heat path between the sensor element and the fluid.

19. The sensor device according to claim 10, comprising a container (20A) including therein the sensor element.

20. The sensor device according to claim 10, comprising a heat conducting material surrounding the sensor element.

21. The sensor device according to claim 10, comprising a fluid-flow control valve responsive to operation of the switch (15).

22. The sensor device according to claim 21, wherein the a fluid-flow control valve comprises a urinal or commode flush-control valve.

23. An automatic flush-control system for a flushed urinal or commode, the system being hydraulically coupled to a supply of water for flushing the urinal or commode, the system comprising:

a sensor mounted in the urinal or commode, the sensor comprising a material located in a space filled with a fluid that has a normal temperature, the material having a temperature-dependent electrical resistivity;

a heat transfer device for bringing the sensor to a temperature different from the normal temperature so that a heat transfer occurs between the sensor and the fluid;

a circuit for detecting a change in the heat transfer due to a change in fluid conditions around the sensor by detecting a change in the resistivity of the material; and a flush-control valve for flushing the urinal or commode when the change in fluid conditions is detected by the circuit.

* * * * *